US011318475B2

(12) United States Patent
Pausch et al.

(10) Patent No.: US 11,318,475 B2
(45) Date of Patent: May 3, 2022

(54) STIRRING MILL

(71) Applicant: NETZSCH-Feinmahltechnik GmbH, Selb (DE)

(72) Inventors: Horst Pausch, Schwarzenbach an der Saale (DE); Gerhard Kolb, Rehau (DE); Holger Moeschl, Selb (DE); Udo Enderle, Arzberg (DE); Witali Sudermann, Marktredwitz (DE); Lars-Peter Weiland, Schönwald (DE)

(73) Assignee: NETZSCH-Feinmahltechnik GmbH, Selb (DE)

( * ) Notice: Subject to any disclaimer, the term of this patent is extended or adjusted under 35 U.S.C. 154(b) by 497 days.

(21) Appl. No.: 16/480,017

(22) PCT Filed: Jan. 30, 2018

(86) PCT No.: PCT/DE2018/000015
§ 371 (c)(1),
(2) Date: Jul. 23, 2019

(87) PCT Pub. No.: WO2018/137731
PCT Pub. Date: Aug. 2, 2018

(65) Prior Publication Data

US 2020/0324297 A1 Oct. 15, 2020

(30) Foreign Application Priority Data

Jan. 30, 2017 (DE) ..... 102017201418.0

(51) Int. Cl.
*B02C 17/16* (2006.01)
*B01F 27/21* (2022.01)
*B01F 33/80* (2022.01)

(52) U.S. Cl.
CPC ..... *B02C 17/163* (2013.01); *B01F 27/212* (2022.01); *B01F 33/80* (2022.01);
(Continued)

(58) Field of Classification Search
CPC ..... B02C 17/163; B02C 17/161; B02C 17/16
See application file for complete search history.

(56) References Cited

U.S. PATENT DOCUMENTS 8,002,213 B2 * 8/2011 Stehr ..... B02C 17/161 241/171
8,794,558 B2 * 8/2014 Pausch ..... B02C 17/18 241/171

(Continued)

FOREIGN PATENT DOCUMENTS

DE 4419919 C1 2/1995
DE 10064828 A1 6/2002

(Continued)

OTHER PUBLICATIONS

International Search Report & Translation Application No. PCT/DE2018/00015 Completed: May 7, 2018; dated May 16, 2018 7 Pages.

(Continued)

*Primary Examiner* — Faye Francis
(74) *Attorney, Agent, or Firm* — Whitmyer IP Group LLC

(57) ABSTRACT

A stirring mill, including a horizontally arranged milling vessel and a stirring shaft which is arranged therein so that it can be rotationally driven are provided. The stirring shaft has a first stirring shaft section adjacent to an inlet for material to be ground, which has a smaller diameter D24, and a second stirring shaft section adjacent to an outlet for material to be ground, which has a larger diameter D25 and in which a separating device is formed. Bypass channels leading into the separating device are formed in the first stirring shaft section.

15 Claims, 7 Drawing Sheets

(52) U.S. Cl.
CPC ..... *B02C 17/16* (2013.01); *B02C 17/161* (2013.01); *B01F 33/83613* (2022.01); *B02C 2017/165* (2013.01)

(56) References Cited

U.S. PATENT DOCUMENTS

| | | | | |
|---|---|---|---|---|
| 9,511,374 | B2 * | 12/2016 | Ishikawa | B02C 17/16 |
| 10,610,871 | B2 * | 4/2020 | Pausch | B02C 17/161 |
| 2005/0224612 | A1 * | 10/2005 | Heinzelmann | B02C 17/161<br>241/172 |
| 2013/0233953 | A1 * | 9/2013 | Enderle | B02C 17/16<br>241/38 |
| 2014/0367504 | A1 * | 12/2014 | Ishikawa | B02C 17/183<br>241/174 |
| 2016/0107163 | A1 * | 4/2016 | Pausch | B02C 17/163<br>241/30 |

FOREIGN PATENT DOCUMENTS

| | | | |
|---|---|---|---|
| DE | 10241924 | B3 | 5/2004 |
| DE | 102013111762 | A1 | 1/2015 |
| EP | 0376001 | A1 | 7/1990 |

OTHER PUBLICATIONS

Written Opinion of the International Searching Authority Application No. PCT/DE2015/000015 dated May 16, 2018 7 Pages.

* cited by examiner

STIRRING MILL

TECHNICAL FIELD

The invention relates to a stirring mill comprising a horizontally arranged milling vessel, which has a cylindrical inner wall, comprising a stirring shaft, which is arranged in the milling vessel and which can be driven about a joint central longitudinal axis in a drive direction of rotation, comprising a milling chamber, which is defined by the inner wall and the stirring shaft, wherein, at a first end of the milling chamber, an inlet for material to be ground discharges into said milling chamber, wherein an outlet for material to be ground opens out from a second end of the milling vessel, which is opposite to the first end of the milling vessel, wherein the stirring shaft has a first stirring shaft section of a smaller diameter D24, which is adjacent to the inlet for material to be ground and which defines a first milling chamber area, and a second stirring shaft section of a larger diameter D25, which is adjacent to the outlet for material to be ground and which defines a second milling chamber area, whereby the following applies: D25>D24, wherein the second stirring shaft section has a hollow space, which is closed by a bottom with respect to the first stirring shaft section and in which a screen is arranged, which is connected to the outlet for material to be ground and which ends at a distance upstream of the bottom, and wherein the second stirring shaft section has slits, which connect the hollow space to the second milling chamber area.

BACKGROUND

In the case of such stirring mills, which are known from DE 100 64 828 B4, the longitudinal slits, which form part of a separating device, extend in the second stirring shaft section slightly into the first stirring shaft section of a smaller diameter. They end approximately in a radial plane with the screen, which forms part of the separating device. The material to be ground flows through the milling vessel from the inlet for material to be ground to the opposite end of the milling chamber and then enters into the hollow space inside the second stirring shaft section, together with the auxiliary milling bodies taken along by the flow of material to be ground. Due to the fact that the hollow space is formed essentially cylindrically, the webs defined by the slits are larger in the end-side area of the stirring shaft than in the area of the cover of the screen. An intensified centrifuging of auxiliary milling bodies and coarse particles of material to be ground thus takes place in the entry region of the hollow space. The radial auxiliary milling body flow from the separating device back into the milling chamber is to thus be intensified thereby.

A stirring mill, which is similar to the above-described stirring mill, is known from DE 10 2013 111 762 A1, in the case of which the stirring shaft has a profile, which is constant across its full length. In the area between the inlet for material to be ground and the separating device, recesses are formed, which run in the longitudinal direction of the stirring shaft and which discharge into the slits, which surround the hollow space comprising the screen in the second stirring shaft section. The purpose of the recesses, which are formed symmetrically to a respective radius, is to convey the auxiliary milling bodies directly into the slits of the separating device, so that an intensified return into the milling chamber takes place. A sufficiently even and compression-free distribution of the auxiliary milling bodies in the milling chamber is not yet attained by means of these known measures.

SUMMARY

The invention is thus based on the object of further developing a stirring mill in such a way that a largely even distribution of the auxiliary milling bodies in the milling chamber is attained by avoiding compressions.

This object is solved according to the invention in that the first stirring shaft section has at least one bypass channel, which penetrates the bottom of the hollow space and connects the first milling chamber area to the hollow space.

It is attained by means of the measures according to the invention that material to be ground, which is largely free from auxiliary milling bodies, is conveyed into the separating device directly in the bypass, thus directly upstream of the screen. There, the fine particles of material to be ground are discharged directly through the outlet for material to be ground. A portion of the material to be ground, which is already sufficiently fine, is thus subjected to a milling process only in the first milling chamber area.

If, according to an advantageous further development of the invention, the at least one bypass channel, which is formed in the first stirring shaft section, extends in the direction of the central longitudinal axis across 10 to 100% or at least 70%, respectively, or at least 80%, respectively, or at least 90%, respectively, of the length L24 of the first stirring shaft section, it can be attained thereby that the material to be ground, which is supplied to the separating device in the bypass, is already freed from auxiliary milling bodies and coarse particles of material to be ground to the desired extent. This effect is attained in particularly pronounced manner, when the at least one bypass channel has an inner diameter D39, which is smaller than the inner diameter D27 of the hollow space.

According to a further advantageous further development of the invention, this effect is improved when the at least one bypass channel is inclined radially to the outside opposite to the drive direction of rotation, because, by means of this formation of the bypass channels, the centrifugal effect, which has a correspondingly stronger effect on auxiliary milling bodies and coarse particles of material to be ground, is intensified.

BRIEF DESCRIPTION OF THE DRAWINGS

Further features, details and advantages of the invention follow from the below description of exemplary embodiments of the invention on the basis of the drawings, in which.

DETAILED DESCRIPTION

Figure 1:
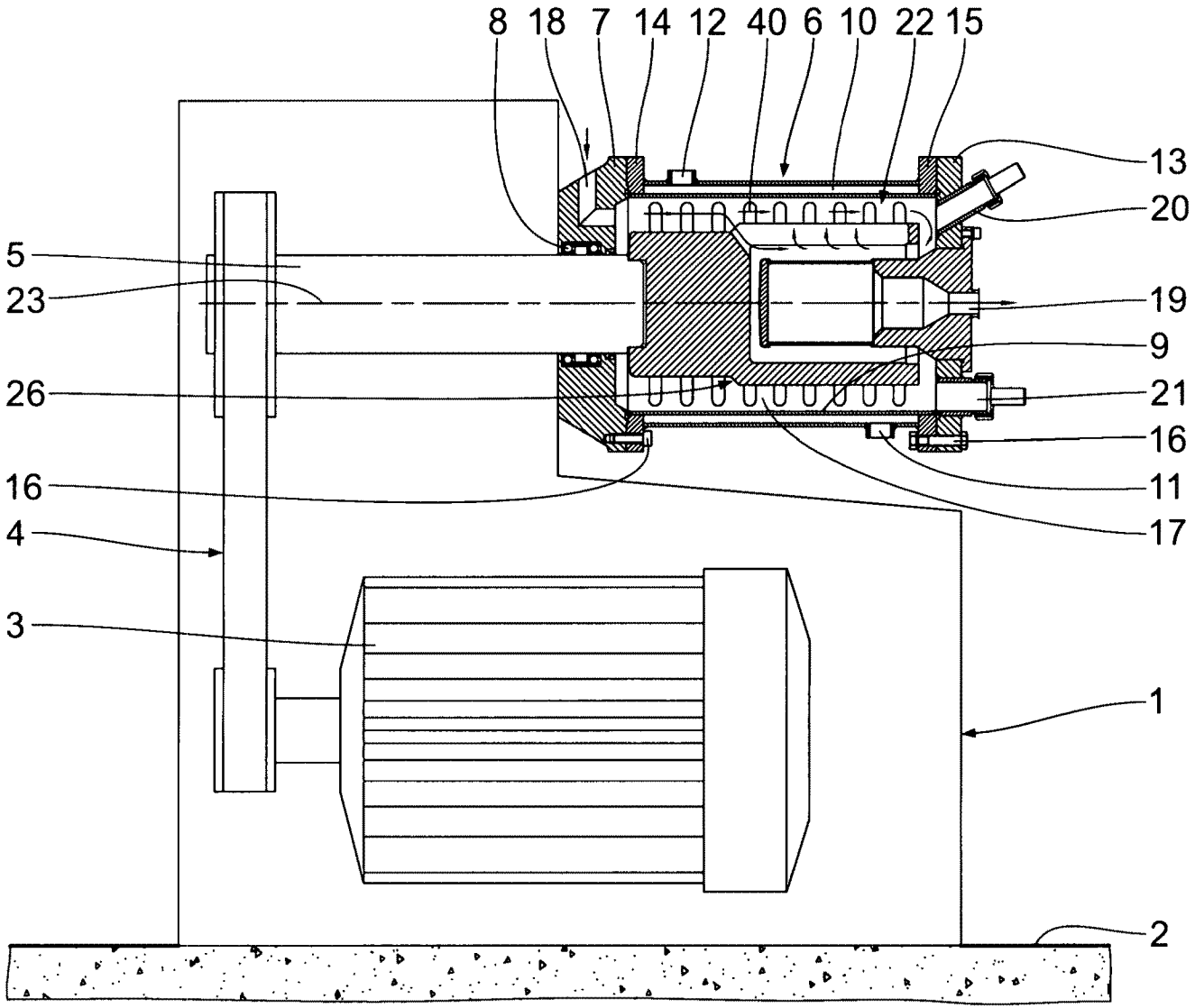
FIG. 1 shows a horizontal stirring mill in vertical longitudinal section.

As can be gathered from FIG. 1, a horizontal stirring mill has a machine frame 1, which is supported on the bottom 2. In the lower area of the machine frame 1, a drive motor 3 is arranged, which is coupled to a drive shaft 5 by means of a belt drive 4.

In the upper area of the machine frame 1, a horizontal milling vessel 6 is fastened to said machine frame. Said milling vessel has a first milling vessel lid 7, which is attached to the machine frame 1 and in which the drive shaft 5 is supported so as to be rotatable by means of ball bearings 8. The milling vessel 6 further has a cylindrical inner wall 9, which is surrounded by a temperature-control jacket 10, into which temperature-control means, usually coolant, is introduced through an intake 11 and is discharged through a drain 12. At the end opposite to the first milling vessel lid 7, thus at a distance to the upper area of the machine frame 1, the milling vessel 6 is closed by means of a second milling vessel lid 13. The connection between the inner wall 9 along with temperature-control jacket 10 to the first lid 7 and the second lid 13 takes place in each case by means of flanges 14, 15 and corresponding screw connections 16. A milling chamber 17, into which an inlet 18 for material to be ground formed in the first lid 7 discharges and from which an outlet 19 for material to be ground arranged in the second lid 13 opens out, is limited by the cylindrical inner wall 9 and the first lid 7 and the second lid 13. An auxiliary milling body filling nozzle 20 furthermore discharges into and an auxiliary milling body outlet nozzle 21 opens out from the milling chamber 17, both of which are also formed on the second lid 13.

A stirring shaft 22, which is connected to the drive shaft 5 in a rotationally filed manner and which can be driven by the latter about a joint horizontal central longitudinal axis 23 of drive shaft 5, milling chamber 17, and stirring shaft 22, is arranged in the stirring chamber 17. The stirring shaft 22 is not supported in the milling chamber 17; it is thus mounted to the drive shaft 5 in a cantilever fashion via its coupling. Adjacent to the inlet 18 for material to be ground, the stirring shaft 22 has two sections, namely a first stirring shaft section 24 comprising an outer diameter D24, and, adjacent thereto, a second stirring shaft section 25 comprising an outer diameter D25. The following applies: D25>D24. A transition section 26 between the first stirring shaft section 24 of a smaller diameter D24 and the second stirring shaft section 25 of a larger diameter D25 is assigned to the first stirring shaft section 24.

Figure 4:
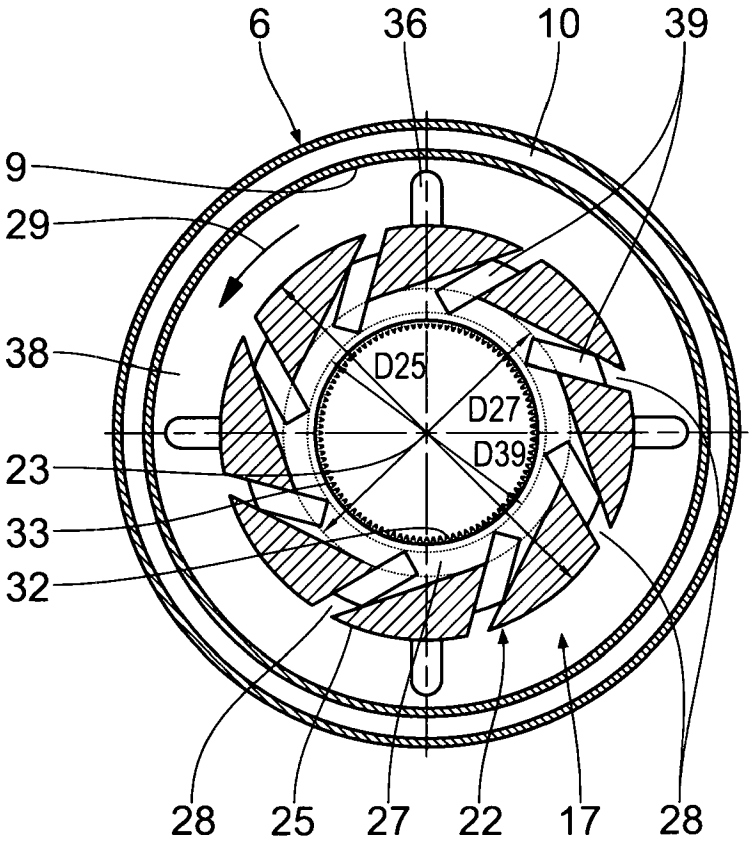
FIG. 4 shows a cross section through the milling vessel according to the sectional line IV-IV in FIG. 2.
Figure 3:
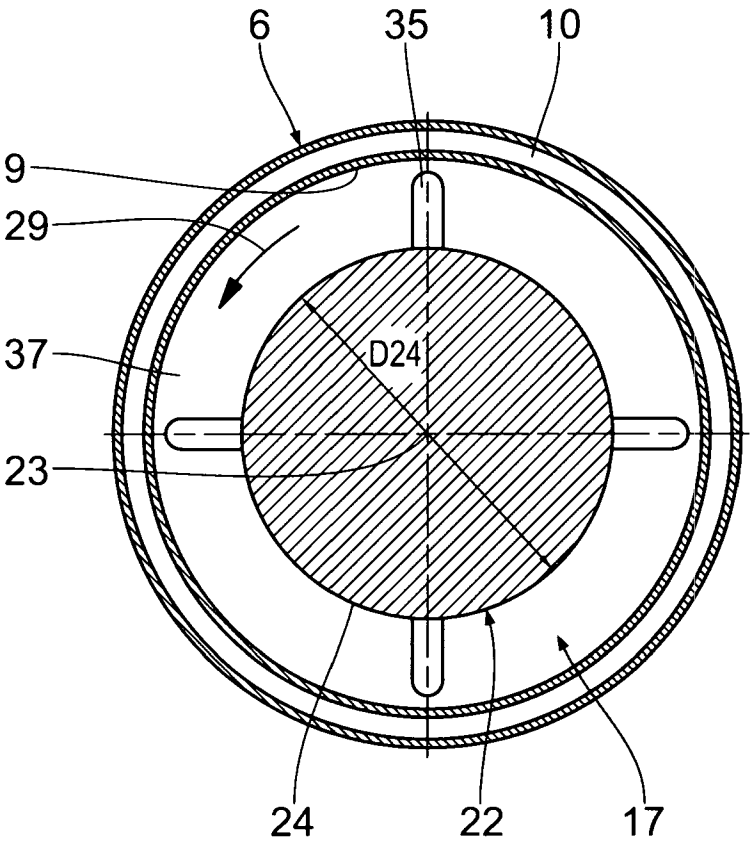
FIG. 3 shows a cross section through the milling vessel according to the sectional line III-III in FIG. 2.

The first stirring shaft section 24 is essentially formed as full material section, while the second stirring shaft section 25 has a hollow space 27, which is open towards the second lid 13. The length L27 of the hollow space 27 in the direction towards the first stirring shaft section 24 is smaller than the length L25 of the second stirring shaft section 25. The following thus applies: L27<L25. The second stirring shaft section 25 has longitudinal slits 28, which are open to the outside and run parallel to the axis 23, and which—as can be gathered from FIG. 4—are inclined radially to the outside opposite to the direction of rotation 29 based on the drive direction of rotation 29 of the stirring shaft 22. At its end adjacent to the second lid 13, the second stirring shaft section 25 is closed by means of an end ring 30, which thus also closes the longitudinal slits 28 in the direction parallel to the axis 23.

In the second stirring shaft section 25, a separating device 31 is formed concentrically to the axis 23 and which consists of the longitudinal slits 28 and of a cylindrical screen 32, which is frontally closed towards the first stirring shaft section 24 by means of a cover 33 and which, at its other end, is held in a base 34, which is fastened to the second lid 13 and has the outlet 19 for material to be ground. As can in particular be gathered from FIG. 2, the screen 32 extends into the vicinity of the end of the hollow space 27 adjacent to the first stirring shaft section 24.

The stirring shaft 22 is covered with stirring elements 35, 36 in the form of stirring pins, which are each mounted at a circumferential distance of 90 degrees to one another on the circumference of the stirring shaft 22 and radially to the axis 23. Four stirring elements 35, 36 are in each case arranged in a plane perpendicular to the axis 23. The stirring elements 35 in the first milling chamber area 37 surrounding the first stirring shaft section 24 are longer than the stirring elements 36 in the second milling chamber area 38 surrounding the second stirring shaft section 25. This follows from the fact that the inner diameter D24 of the first milling chamber 37 is smaller than the inner diameter D25 of the second milling chamber area 38 and that all stirring elements 35, 36 end at the same distance from the inner wall 9 of the milling vessel 6. In the second stirring shaft section 25, two longitudinal slits 28 are in each case formed between two stirring elements 35, which are offset from one another by 90 degrees. Depending on the size of the stirring mill, the circumferential distance of the stirring elements 35 can be smaller than 90°. As the case may be, there are no longer two, but only one longitudinal slit 28, which is then formed in such a case between two stirring elements 35, which are adjacent in a circumferential plane.

In the case of the exemplary embodiment illustrated in FIGS. 1 to 4, bypass channels 39 are formed in the transition section 26 from the first stirring shaft section 24 of a smaller diameter D24 to the second stirring shaft section 25 of a larger diameter, which bypass channels connect the first milling chamber area 37 surrounding the first stirring shaft section 24 to the hollow space 27. As can be gathered from FIG. 2 and FIG. 4, these bypass channels 39 discharge into the longitudinal slits 28 and are located upstream of the hollow space 27, thus in the full material area of the stirring shaft 22, based on the flow-through direction 40 from the inlet 18 of material to be ground to the outlet 19 of material to be ground. They thus discharge through the bottom 41 of the hollow space 27 into the latter. As can be gathered from FIG. 2, these bypass channels 39 can be formed to be relatively short. Their axial length L39 is at least 10% of the length L24 of the first stirring shaft section 24. The following thus applies: L39>=0.1 L24.

Figure 5:
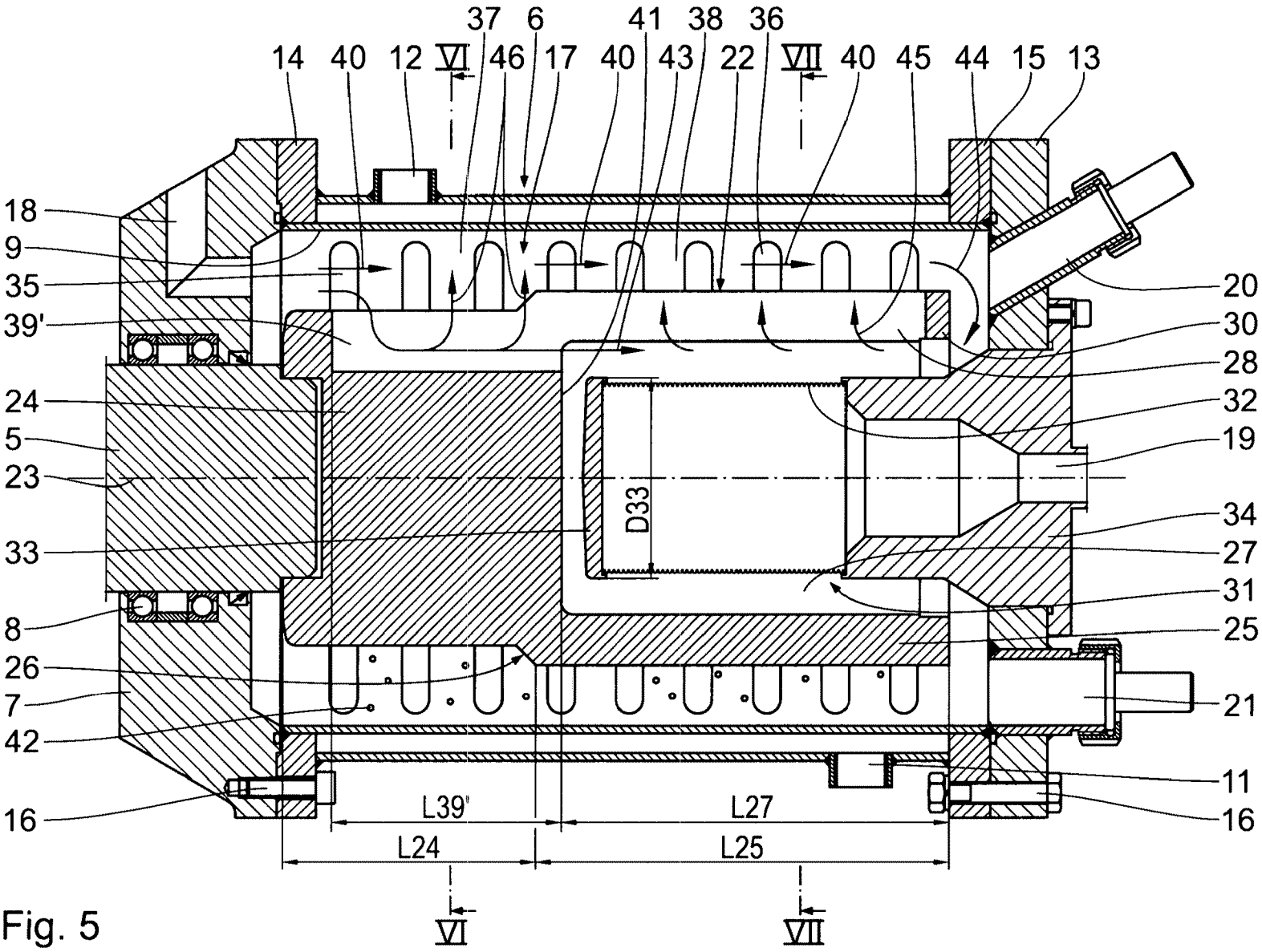
FIG. 5 shows an embodiment of a milling vessel, which is modified with respect to FIG. 2, in vertical longitudinal section.
Figure 7:
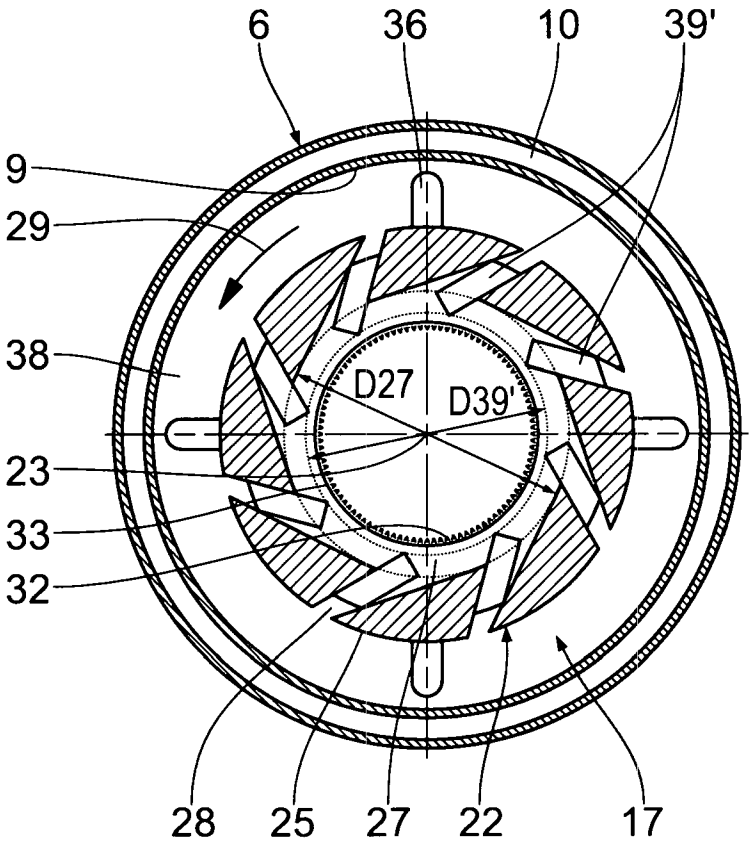
FIG. 7 shows a cross section through the milling vessel according to the sectional line VII-VII in FIG. 5.

As can be gathered from the embodiment according to FIGS. 5 and 7, which is modified with regard to the embodiment of the bypass channels, the bypass channels 39' can extend across a significant portion of the length L24 of the first stirring shaft section 24, namely across the full length thereof in the limit case, in which the bypass channels 39' are then axially open towards the first milling vessel lid 7. The following then applies: L24>=L39'>=0.1 L24. In other words, this means that the axial length L39' is in the range of between 10% and 100% of the length L24 of the first stirring shaft section 24. Preferably, the bypass channels 39' are relatively long. The following thus preferably applies for them: L39'>=0.7 L24 or L39'>=0.8 L24, respectively, and L39'>=0.9 L24.

As follows from the drawing, the bypass channels 39, 39' are inclined opposite to the direction of rotation 29 in the same way as the longitudinal slits 28—viewed from the central longitudinal axis 23 to the outside. They thus discharge axially into the longitudinal slits 28. The bypass channels 39, 39' furthermore have—at least in the transition area 26—an inner diameter D39, D39', which is smaller than the inner diameter D27 of the hollow space 27, so that the bypass channels 39, 39' discharge directly through the bottom 41 of the hollow space 27 into the latter. The inner diameter D39, D39' is slightly larger than the outer diameter D33 of the cover 33 of the screen 32.

Figure 6:
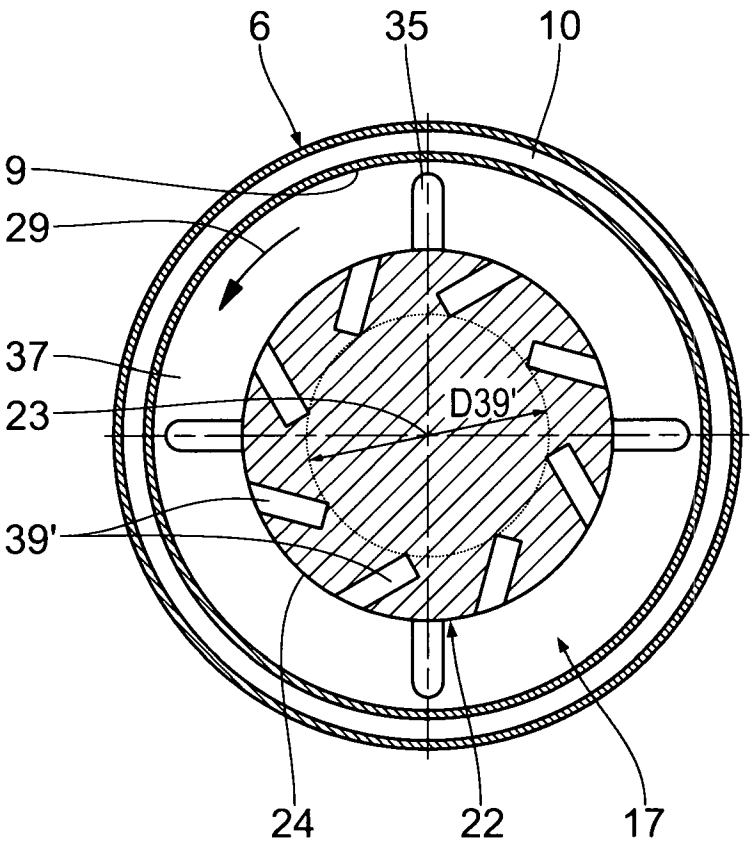
FIG. 6 shows a cross section through the milling vessel according to the sectional line VI-VI in FIG. 5.
Figure 8:
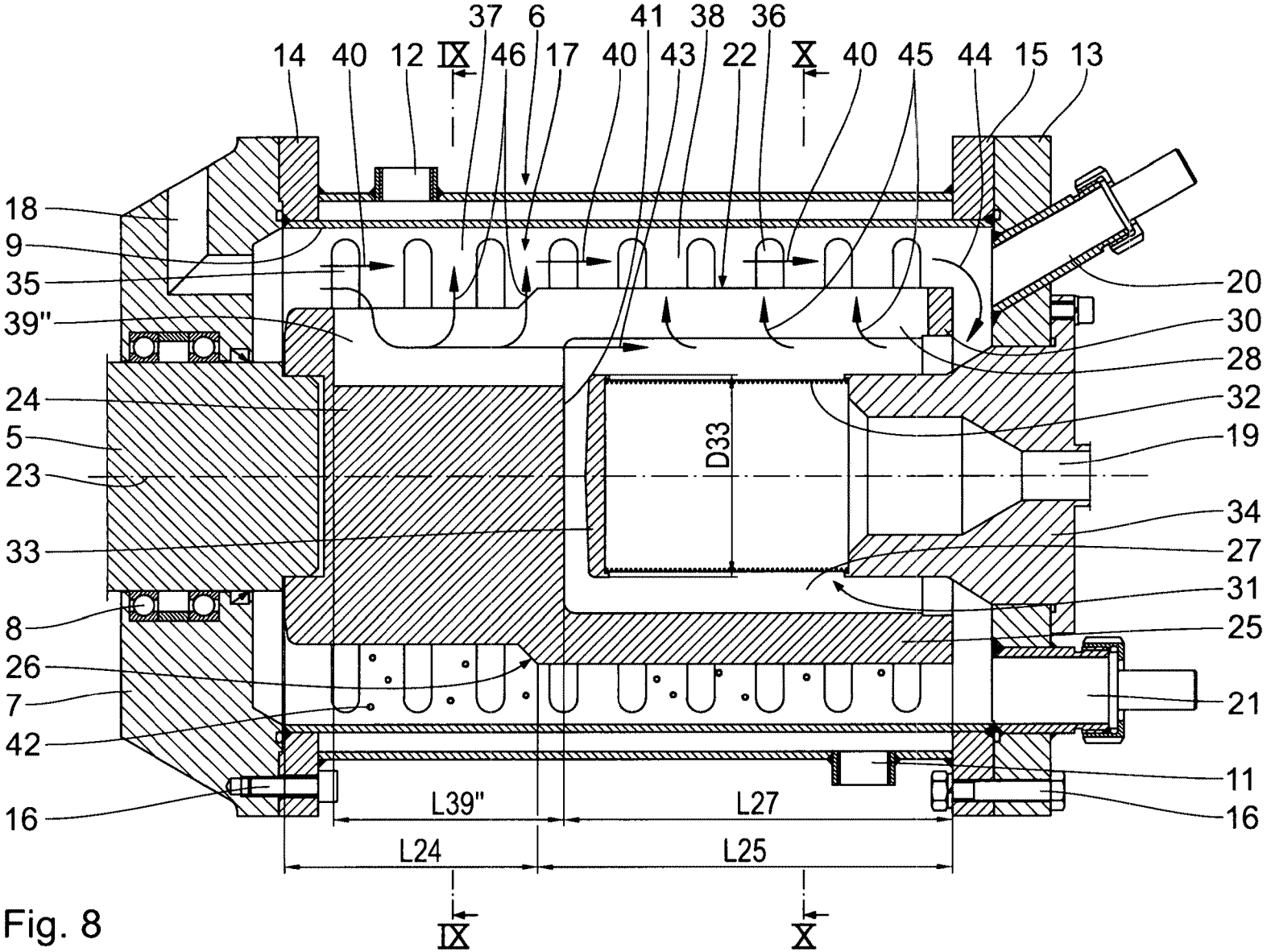
FIG. 8 shows an embodiment of a milling vessel, which is modified with respect to FIG. 5, in vertical longitudinal section.
Figure 10:
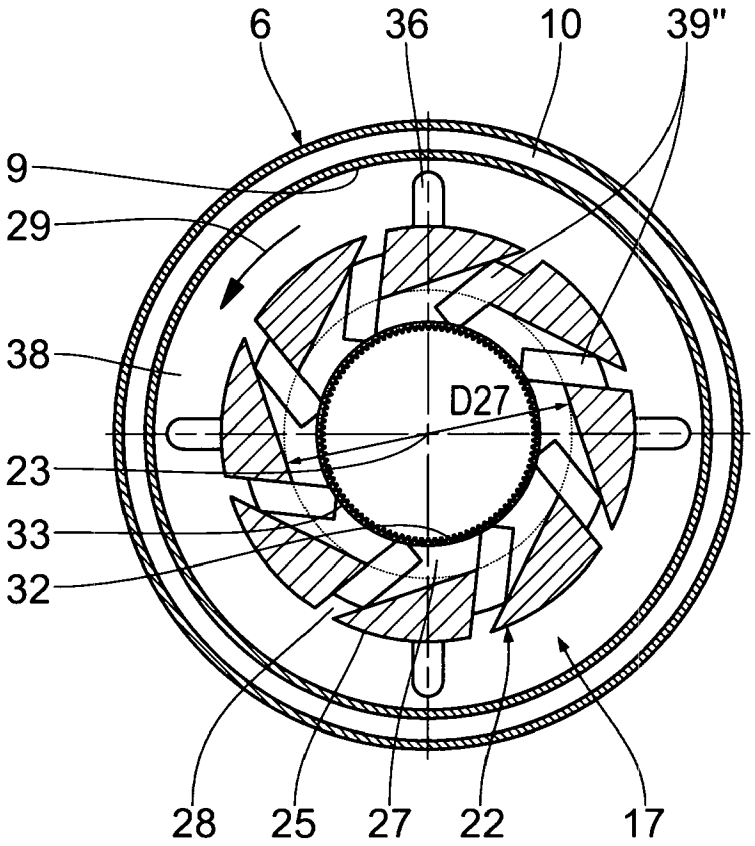
FIG. 10 shows a cross section through the milling vessel according to the sectional line X-X in FIG. 8.
Figure 9:
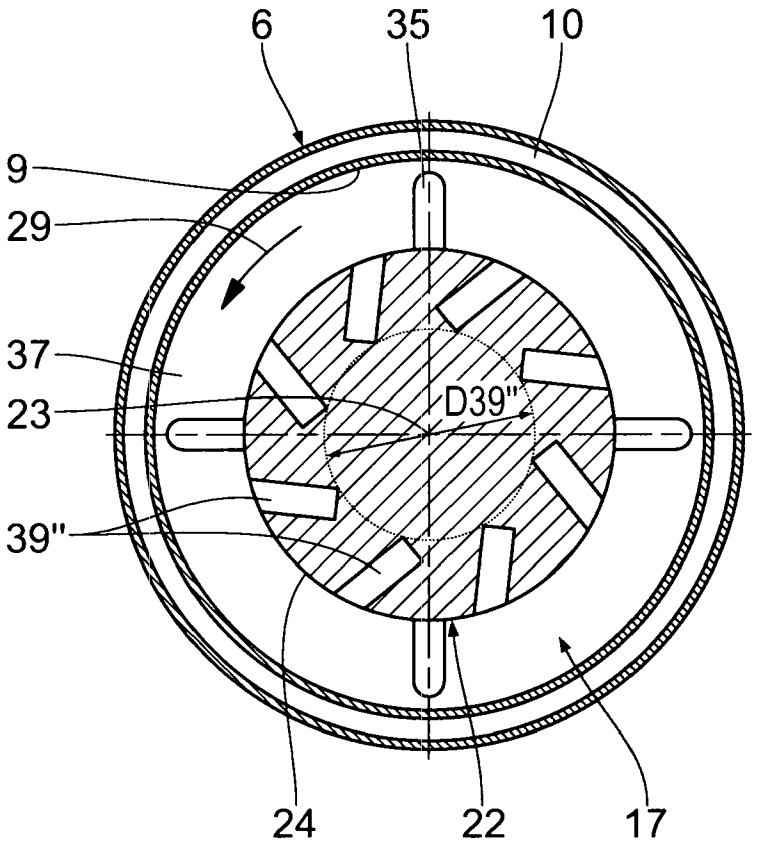
FIG. 9 shows a cross section through the milling vessel according to the sectional line IX-IX in FIG. 8.

The exemplary embodiment according to FIGS. 8 to 10 differs from that according to FIGS. 5 to 7 only in that the inner diameter D39" of the bypass channels 39" is smaller than the outer diameter D33 of the cover 33 of the screen 32. It goes without saying that this can also be the case in the exemplary embodiment according to FIGS. 1 to 4.

The mode of operation is as follows:

The milling chamber 17, thus the free space located between the inner wall 9 and the stirring shaft 22, is filled with only suggested auxiliary milling bodies 42 up to approximately 90%. The diameter D42 of the auxiliary milling bodies 42 lies in the range of between 0.03 mm and 0.8 mm and preferably in the range of between 0.03 mm and 0.4 mm. The material to be ground or to be dispersed, respectively, is pumped through the inlet 18 for material to be ground into the milling vessel 6 and flows through the milling chamber 17 in flow-through direction 40 under intensive stress caused by the stirring elements 35, 36 and the auxiliary milling bodies 42, whereby the average flow-through speed in the first milling chamber area 37 is lower than in the second milling chamber area 38, namely due to the free cross sections of different sizes of these milling chamber areas 37, 38.

Figure 2:
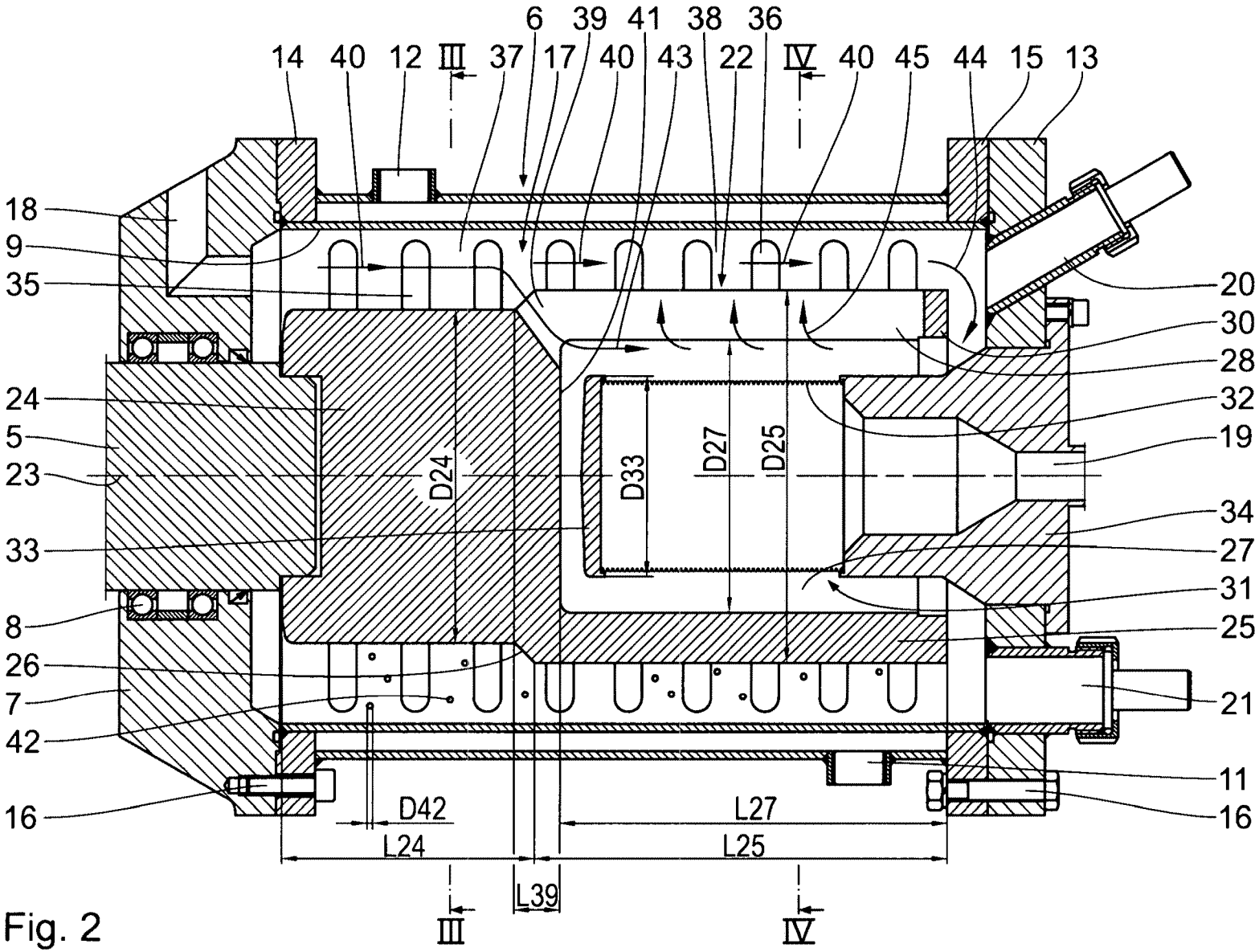
FIG. 2 shows the milling vessel of the stirring mill in the vertical longitudinal section in a scale, which is enlarged with respect to FIG. 1.

As can be gathered from FIG. 2, a portion of the material to be ground flows through the bypass channels 39 directly into the hollow space 27 according to the flow arrow 43, and leaves the milling chamber 17 through the screen 32, insofar as this material to be ground has a fineness, which allows it to pass through the screen 32. The material to be ground, which is not discharged through the screen 32, is removed through the longitudinal slits 28 into the second milling chamber area 38 by means of centrifugation. A further portion of the material to be ground is conveyed through the second milling chamber area 38 under further intensive impact by the auxiliary milling bodies 42, and flows around the end ring 30 into the hollow space 27 between the screen 32 and the second stirring shaft section 25, where the auxiliary milling bodies 42 and coarse particles of material to be ground are centrifuged through the longitudinal slits 28 into the second milling chamber area 38 according to the flow arrows 45, which are directed to the outside, in a more pronounced manner as fine particles of material to be ground.

Due to the relatively slower flow speed of the material to be ground in the first milling chamber area 37 as compared to the second milling chamber area 38, the risk of the compaction and compression of auxiliary milling bodies 42 in the first milling chamber area 37 is lower than in the second milling chamber area 38. Due to the fact that a portion of the material to be ground is already supplied directly from the first milling chamber area 37 of the separating device 31 through the bypass channels 39, the flow speed of material to be ground is also reduced in the second milling chamber area 38, so that the risk of compressions of the auxiliary milling bodies 42 is reduced there as well.

When the bypass channels 39', 39" extend across a longer length L39', L39" in the direction of the inlet 18 of material to be ground—as in the exemplary embodiments according to FIGS. 5 to 7 and 8 to 10, the stream of material to be ground, which is supplied directly to the separating device 31 in the bypass, is then increased as compared to the exemplary embodiment according to FIGS. 1 to 4, because, due to the described embodiment of the bypass channels 39', 39", auxiliary milling bodies 42 and coarse particles of material to be ground are centrifuged from the bypass channels 39" radially into the first milling chamber area 37 according to the illustrated directional arrows 46, in a more pronounced manner as fine particles of material to be ground. This applies for the exemplary embodiment according to FIGS. 8 to 10 in a particular manner.

The risk of compressions of auxiliary milling bodies 42 is greatly reduced by means of the described measures, so that a significant throughput increase is made possible. This provides significant advantages, in particular in the case of the so-called passage operation; material to be ground is thereby conveyed several times through the milling vessel 6 in circulation.

The invention claimed is:

1. A stirring mill comprising:

a horizontally arranged milling vessel, which has a cylindrical inner wall, a stirring shaft, which is arranged in the milling vessel and which can be driven about a joint central longitudinal axis in a drive direction of rotation, a milling chamber, which is defined by the inner wall and the stirring shaft, wherein, at a first end of the milling chamber, an inlet for material to be ground discharges into said milling chamber, wherein an outlet for material to be ground opens out from a second end of the milling vessel, which is opposite to the first end of the milling vessel, wherein the stirring shaft has a first stirring shaft section of a smaller diameter D24, which is adjacent to the inlet for material to be ground and which defines a first milling chamber area, and a second stirring shaft section of a larger diameter D25, which is adjacent to the outlet for material to be ground and which defines a second milling chamber area, whereby the following applies: D25>D24, wherein the second stirring shaft section has a hollow space, which is closed by a bottom with respect to the first stirring shaft section and in which a screen is arranged, which is connected to the outlet for material to be ground and which ends at a distance upstream of the bottom, wherein the second stirring shaft section has slits, which connect the hollow space to the second milling chamber area, and wherein the first stirring shaft section has at least one bypass channel, which penetrates the bottom of the hollow space and connects the first milling chamber area to the hollow space.

2. The stirring mill according to claim 1, wherein the at least one bypass channel has an inner diameter D39, D39', D39", which is smaller than the inner diameter D27 of the hollow space.

3. The stirring mill according to claim 1, wherein the at least one bypass channel, which is formed in the first stirring shaft section, extends in the direction of the central longitudinal axis across 10 to 100% of the length L24 of the first stirring shaft section.

4. The stirring mill according to claim 1,
wherein the at least one bypass channel is inclined radially to the outside opposite to the drive direction of rotation.

5. The stirring mill according to claim 1,
wherein the at least one bypass channel runs parallel to the central longitudinal axis.

6. The stirring mill according to claim 1,
wherein the at least one bypass channel transitions partially into a slit of the second stirring shaft section.

7. The stirring mill according to claim 1,
wherein a transition section is formed between the first stirring shaft section and the second stirring shaft section, and that the bypass channel is formed at least partially in this transition section.

8. The stirring mill according to claim 3,
wherein the at least one bypass channel, which is formed in the first stirring shaft section, extends in the direction of the central longitudinal axis across at least 70% of the length L24 of the first stirring shaft section.

9. The stirring mill according to claim 3,
wherein the at least one bypass channel, which is formed in the first stirring shaft section, extends in the direction of the central longitudinal axis across at least 80% of the length L24 of the first stirring shaft section.

10. The stirring mill according to claim 3,
wherein the at least one bypass channel, which is formed in the first stirring shaft section, extends in the direction of the central longitudinal axis across at least 90% of the length L24 of the first stirring shaft section.

11. The stirring mill according to claim 2, wherein the at least one bypass channel, which is formed in the first stirring shaft section, extends in the direction of the central longitudinal axis across 10 to 100% of the length L24 of the first stirring shaft section.

12. The stirring mill according to claim 2,
wherein the at least one bypass channel is inclined radially to the outside opposite to the drive direction of rotation.

13. The stirring mill according to claim 2,
wherein the at least one bypass channel runs parallel to the central longitudinal axis.

14. The stirring mill according to claim 2,
wherein the at least one bypass channel transitions partially into a slit of the second stirring shaft section.

15. The stirring mill according to claim 2,
wherein a transition section is formed between the first stirring shaft section and the second stirring shaft section, and that the bypass channel is formed at least partially in this transition section.

* * * * *